US005333781A

United States Patent [19]

Roccaforte

[11] Patent Number: 5,333,781

[45] Date of Patent: Aug. 2, 1994

[54] RECLOSEABLE CARTON WITH POURING SPOUT

[75] Inventor: Harry I. Roccaforte, Chicago, Ill.

[73] Assignee: Waldorf Corporation, St. Paul, Minn.

[21] Appl. No.: 3,544

[22] Filed: Jan. 13, 1993

Related U.S. Application Data

[62] Division of Ser. No. 798,924, Nov. 27, 1991, Pat. No. 5,205,480.

[51] Int. Cl.[5] ..... B65D 5/70

[52] U.S. Cl. ..... 229/229; 229/221

[58] Field of Search ..... 229/102, 210, 215, 217, 229/221, 229, 219

[56] References Cited

U.S. PATENT DOCUMENTS

| | | | |
|---|---|---|---|
| 1,303,138 | 5/1919 | Woolwine | 229/229 |
| 1,424,127 | 7/1922 | Thole . | |
| 2,002,485 | 5/1935 | Alfred | 229/217 |
| 2,010,863 | 8/1935 | Johnson | 229/217 |
| 2,105,547 | 1/1938 | Mergentheim . | |
| 2,129,980 | 9/1938 | Alfred . | |
| 2,166,222 | 7/1939 | Ranko et al. . | |
| 2,326,527 | 8/1943 | Emmerich . | |
| 2,341,397 | 2/1944 | Smith | 229/217 |
| 2,766,922 | 10/1956 | Moore . | |
| 2,812,127 | 11/1957 | Graybill . | |
| 3,157,344 | 11/1964 | Hennessey . | |
| 3,195,283 | 7/1965 | Broersma | 383/67 X |
| 3,202,336 | 8/1965 | Bord . | |
| 3,346,166 | 10/1967 | Koolnis . | |
| 3,395,848 | 8/1968 | Johnson . | |
| 3,438,565 | 4/1969 | Lugt et al. . | |
| 3,971,506 | 7/1976 | Roenna . | |
| 4,168,003 | 9/1979 | Wysocki . | |
| 4,183,436 | 1/1980 | Engelhardt et al. . | |
| 4,308,956 | 1/1982 | Steinke . | |
| 4,650,078 | 3/1987 | Desmond et al. . | |
| 4,706,875 | 11/1987 | Blackman | 229/229 |
| 4,738,365 | 4/1988 | Prater . | |
| 4,799,594 | 1/1989 | Blackman | 229/229 |
| 5,145,111 | 9/1992 | Giblin | 229/217 X |

*Primary Examiner*—Allan N. Shoap
*Assistant Examiner*—Christopher McDonald
*Attorney, Agent, or Firm*—Dorsey & Whitney

[57] ABSTRACT

A recloseable pouring spout structure for a wall of a product dispensing carton has a first wall panel connected to the carton at a first fold line. The first wall panel has a first aperture. There is a second wall panel connected to the carton at a second fold line generally parallel and opposite to the first fold line. The second wall panel lies interior to the first wall panel and has an opener tab therein defined by a leader edge that is generally parallel to the second fold line, a hinge line generally parallel to the leader edge and a pair of generally parallel opposed side edges extending between the hinge line and the leader edge. At least one locking tab is present on one of the side edges intermediate the leader edge and the hinge line. The locking tab extends in a direction generally perpendicular to the extension direction of the leader tab and is positioned to underlie and engage an edge of the first aperture when the locking tab is in the plane of the second wall panel. There is a third wall panel connected to the carton at a third fold line generally perpendicular to the first and second fold lines. The third wall panel lies interior to the first and second wall panels and has one or more product dispensing apertures therein. A flat blank for forming the carton is also encompassed.

18 Claims, 8 Drawing Sheets

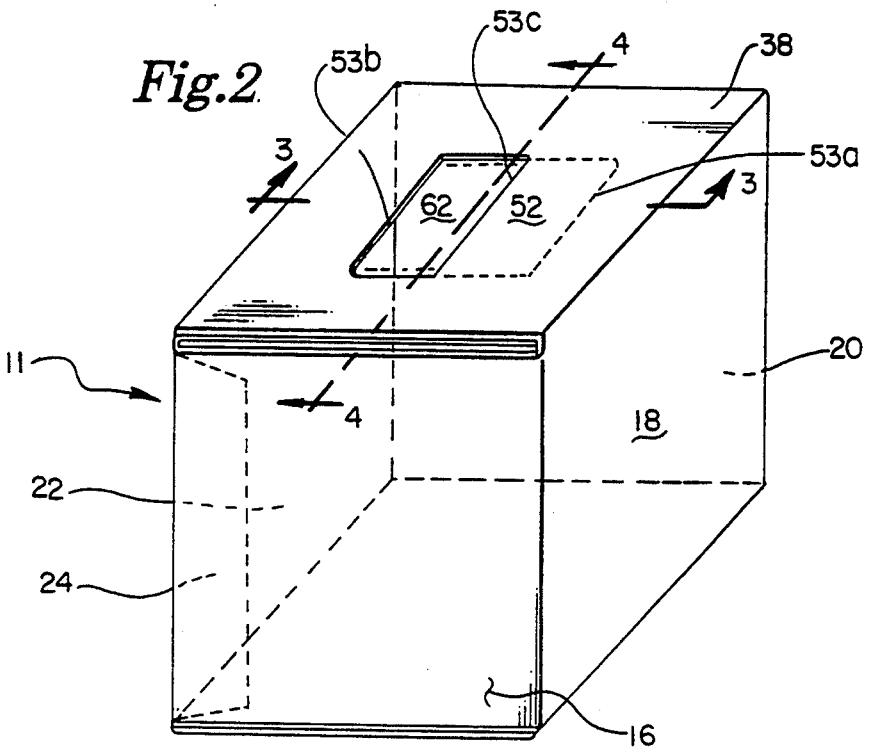
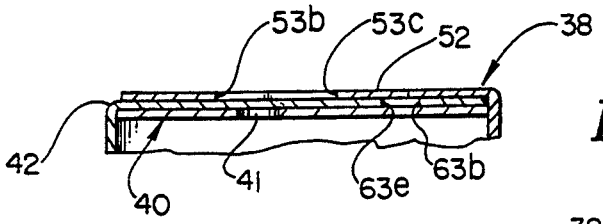
Fig.3
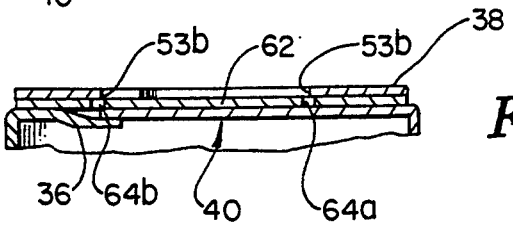
Fig.4

253d
256
257
15
254
253a
252
253b
238
240
263b
266
211
15
218
216
224

253d
252

252
263b
254
238
253d
260
242
237a
236
240
241

RECLOSEABLE CARTON WITH POURING SPOUT

This is a division of application Ser. No. 07/798,924 filed Nov. 27, 1991 now U.S. Pat. No. 5,205,480.

TECHNICAL FIELD

The present invention relates to dispensing cartons and, more particularly, to a carton for containing materials requiring protection against sifting of the contents wherein the carton is formed from a single piece blank and includes an easily openable and recloseable pouring spout, as well as a structure that aids in detecting tampering with the product.

BACKGROUND ART

Foldable, erectable paperboard cartons or containers have long been recognized as an inexpensive and efficient way to contain many materials for many purposes. Over the years, cartons have been provided with specific features depending on the use of the carton, both in terms of the material to be contained therein and in terms of handling the carton itself.

One area of prior work has been the development of cartons and material for forming cartons for containing hygroscopic material or other materials requiring a degree of barrier, such as various soap powders, sweeteners or pancake mixes. This type of container is particularly adapted to prevent the absorption of moisture by the material contained in the carton and also to prevent leakage of the material, by having, for example, films or other coatings applied to or integrated with the carton walls. Sifting can be a particular problem, because the materials are typically in powder or fine granulated form and as such, easily penetrate unsealed seams or perforated lines on the carton having cuts that penetrate completely through carton walls, if the materials are in direct contact with the cuts and the cuts lead directly to the outside.

There have been attempts in the prior art to provide a container that addresses the above concerns. U.S. Pat. No. 4,732,315 discloses a recloseable dispensing package that has a plastic fitment mounted over a cutout area in one flap and an overlying closure flap. Another structure for forming a recloseable opening in a carton for containing a hygroscopic material is present in U.S. Pat. No. 4,718,557, wherein an outside panel may be opened to expose a weakened region that may be partially or fully severed from an inside panel. Also representative of the prior art is U.S. Pat. No. 1,303,138, which discloses a carton with a hinged flap that overlies pouring perforations in an inner flap.

U.S. Pat. No. 3,346,165 discloses an easy opening recloseable container including a dispenser for dispensing the contents. In particular, a portion of the container, severable along perforated lines to form a hinged flap, overlies an opening.

U.S. Pat. No. 2,819,832 discloses a leakproof carton having superimposed inside and outside spout openings. However, when double perforated flap structures are used, the material contained in the carton may still leak out and moisture may easily penetrate the carton, leading to contaminated contents, when the perforations are through cuts and cuts in separate layers are adjacent or superimposed. Thus, such prior art structures lack desired barrier qualities.

A carton having a double panel end closure with an opening flap in the outer panel providing access to a dispensing aperture in an inner panel is shown in U.S. Pat. No. 4,909,395. The opening structure includes a partially pre-cut bridge in the adhesive area for securing the outer opening flap to the inner panel. One problem with opening features of the type shown in this and other prior patents is that coating materials or adhesives used between inner and outer panels may penetrate the perforations or scores or be inaccurately applied, thereby interfering with opening the carton. Also, cuts that run from the carton exterior to the inner opening can provide a path for moisture entry.

For some packages, particularly those that contain foodstuffs, it is desirable to have an opening structure that can provide evidence of possible tampering. The prior art includes packages in which opening involves tearing a perforated line or removing a tab or band that blocks access to the dispenser opening. U.S. Pat. No. 1,424,127 shows a box with a sticker used to seal the cover in a closed position. U.S. Pat. No. 4,569,443 shows a carton with a pouring spout that includes a removable access tab that provides a means that for determining whether tampering has occurred. U.S. Pat. Nos. 3,395,848, 4,706,875 and 4,799,594 all show recloseable opening and dispensing structures for cartons in which the perforations or other lines of weakening used to form a portion of the structure will help to evidence tampering if they appear to have been torn.

Despite the above-cited prior art, there remains a need for a carton for packaging powdered materials that prevents leakage and provides barrier protection for the material contained in the carton, while at the same time providing tamper evidence and a pour spout that is easy for a consumer to open. Further, it is desirable for such a carton to be easy to reclose and that the reclosed opening be effective to limit significant entry of air, which might affect the powdered materials.

SUMMARY OF THE INVENTION

Accordingly, the present invention provides an opening structure for a carton containing products requiring a degree of barrier protection from moisture and other contaminants, yet which enables a consumer to have easy access to the product and to reclose the carton after the initial opening.

A product dispensing carton incorporating the inventive opening structure is generally tubular, having a material receiving central cavity formed by side and end walls. A recloseable pouring spout structure for a wall of the carton has a first wall panel connected to the carton at a first fold line. The first wall panel has a first aperture. There is a second wall panel connected to the carton at a second fold line generally parallel and opposite to the first fold line. The second wall panel lies interior to the first wall panel and has an opener tab therein defined by a leader edge that is generally parallel to the second fold line, a hinge line generally parallel to the leader edge and a pair of generally parallel opposed side edges extending between the hinge line and the leader edge. At least one locking tab is present on one of the side edges intermediate the leader edge and the hinge line. The locking tab extends in a direction generally perpendicular to the extension direction of the leader tab and is positioned to underlie and engage an edge of the first aperture when the locking tab is in the plane of the second wall panel. There is a third wall panel connected to the carton at a third fold line generally perpendicular to the first and second fold lines. The third wall panel lies interior to the first and second wall panels and has one or more product dispensing apertures therein. A flat blank for forming the carton is also encompassed.

An object of the present invention is to provide a package, and a blank for forming the package, whereby materials susceptible to contamination may be contained therein with little danger of becoming contaminated, yet a purchaser can easily manipulate the package opening structure to dispense the contents and conveniently and easily and effectively reclose the package.

Other objects of the present invention are: to provide an easily openable container for powdered materials that avoids perforated score lines having direct contact with the contained product and leading directly to the outside, through which leakage of the material might occur; to provide a package wherein complicated, difficult to manipulate, expensive films or inserts for closing the container or sealing the opening in the container to maintain product integrity are not required; to provide a multi-layer wall panel structure containing a tearable opening structure; and to provide a container that offers evidence of tampering.

Important advantages of the present invention are that it combines specific shipping and packaging advantages, such as reduced contamination and leakage of material contained therein, with specific point of use advantages, such as enhanced ease of opening and reclosing and tamper evidence.

Other objects and advantages of the present invention will become more fully apparent and understood with reference to the following specification and to the appended drawings and claims.

BRIEF DESCRIPTION OF THE DRAWINGS

FIG. 2 is a perspective view of the blank of FIG. 1, formed into a carton in accordance with the present invention.

FIG. 3 is a fragmentary cross-sectional view of the carton taken along line 3—3 of FIG. 2.

FIG. 4 is a fragmentary cross-sectional view of the carton taken along line 4—4 of FIG. 2.

DETAILED DESCRIPTION OF THE PREFERRED EMBODIMENT

Figure 1:
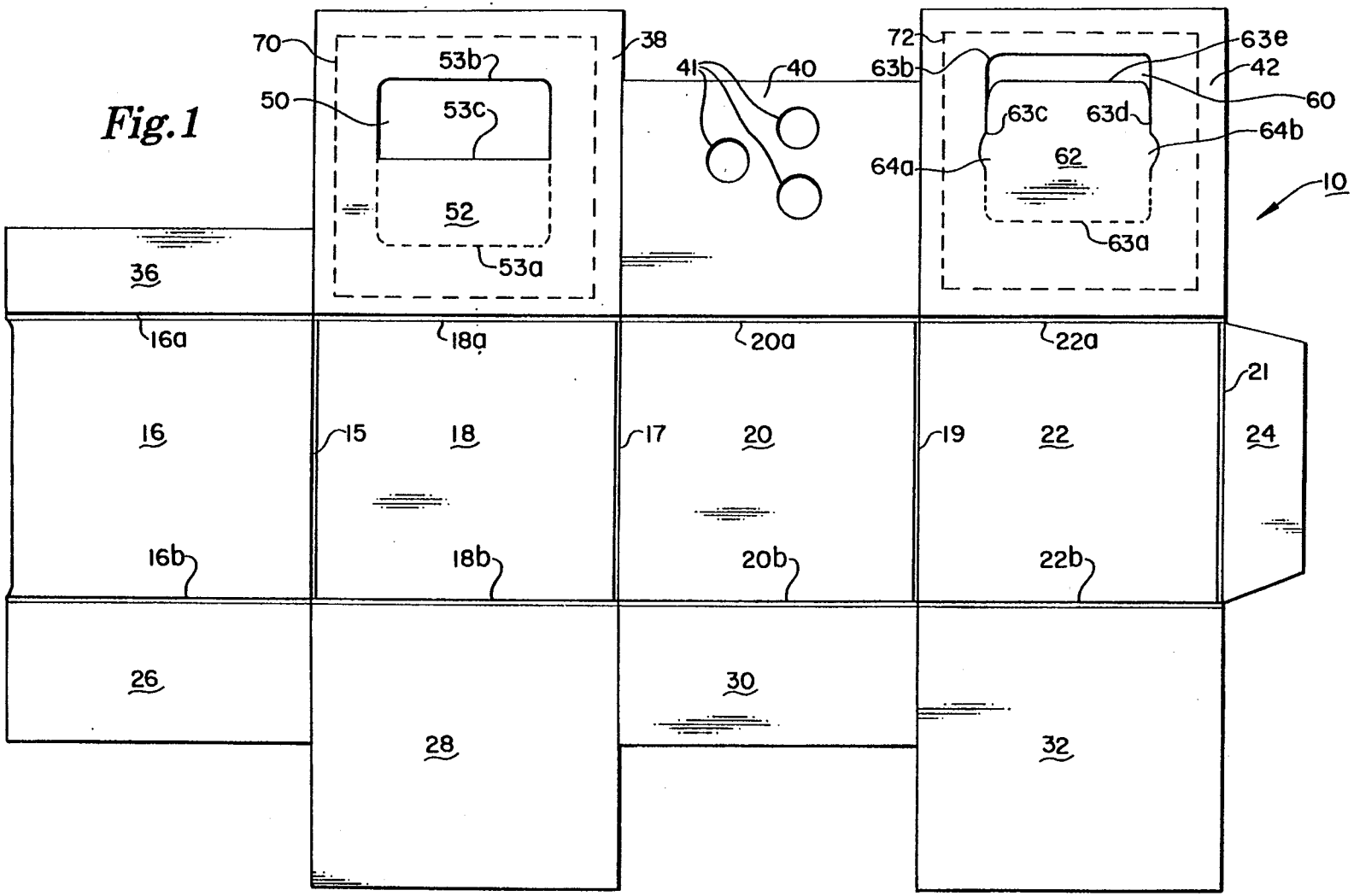
FIG. 1 is a top plan view of the printed (outside) surface of the blank from which the preferred embodiment of the present invention is formed and shows the die cut profile thereof.

FIG. 1 depicts the outside surface of a blank 10 for forming, in accordance with the present invention, a carton 11 as depicted in FIG. 2. The carton 11 comprises a generally tubular body (the height of which is shown foreshortened for convenience in drawing) defining a cavity therein. The body is formed by opposed, parallel front and rear panels 16, 20; opposed, parallel side panels 18, 22; and top and bottom end-closure walls, each made from a set of cooperating overlapping end wall panels.

The blank 10 is formed by die cutting and scoring paperboard or other similar sheet material. In the drawings, the double lines indicate fold score lines, usually provided to foldably interconnect various panels. Single, unbroken lines depict cuts that extend through or partially through the panels or depict free edges of the panels. Single, broken lines depict perforated score lines.

As best seen in FIG. 1, the side panels 18, 22 and front and rear panels 16, 20 are joined at parallel main body fold lines 15, 17, 19. A glue flap 24 is provided at a further main body fold line 21 (parallel to fold lines 15, 17, 19) along one edge of side panel 22 to secure the carton 11 in its generally tubular erected configuration.

Major and minor bottom end wall panels 26, 28, 30, 32 are joined to the lower edges of panels 16, 18, 20 and 22, respectively, at fold lines **16*b*, 18*b*, 20*b*, 22*b*, as shown in FIG. 1. Major and minor top end wall panels 36 (minor panel), 38 (major outer panel), 40 (minor panel), 42 (major inner panel) are joined to the upper edges of panels 16, 18, 20 and 22, respectively, at fold lines 16*a*, 18*a*, 20*a*, 22*a*, as shown in FIG. 1. The fold lines joining bottom end wall panels 26, 28, 30, 32 to panels 16, 18, 20 and 22 are generally parallel to the fold lines joining top end wall panels 36, 38, 40 and 42 to panels 16, 18, 20 and 22 and both are perpendicular to the main body fold lines 15, 17, 19, 21 joining panels 16, 18, 20, 22 and 24**.

The major top outer panel 38 is provided with a first aperture or opening 50. The opening 50 is generally square in shape and centered within the panel 38. It has a perimeter defined by a generally U-shaped line of perforations **53*a* the ends of which connect to the ends of an opposed, generally U-shaped cut line 53*b*. A portion of the opening 50 as defined by the U-shaped line of perforations 53***a* is occupied by a tamper evidence tab 52. Tab 52 has a finger edge 53*c*, which connects the ends of the legs of U-shaped line 53*a*.

Further reference to FIG. 1 shows that the major top inner panel 42 has a second aperture or opening 60. The opening 60 is generally square in shape and centered within the panel 42. It has a perimeter defined by a generally U-shaped line of perforations 63*a*, the ends of which connect to the ends of an opposed, generally U-shaped cut line 63*b*. Adjacent at least one (preferably each) of the ends of cut line 63*b*, the cut line 63*b* curves or exteriors outwardly away from the center of aperture 60 to form at least one (preferably two) locking tabs 64*a*, 64*b*, defined by curved cut line segments 63*c*, 63*d*. A portion of the opening 60 as defined by the U-shaped line of perforations 63*a*, curved cut line segments 63*c*, 63*d* and a portion of the legs of U-shaped cut line 63*b*, is occupied by an opener tab 62. Opposite line 63*a* tab 62 has a finger edge 63*e*, which connects the legs of U-shaped cut line 63*b*.

As further seen in FIG. 1, minor top wall panel 40 incorporates one or more dispenser apertures 41. As will be seen later, these apertures 41 are positioned so that when panel 38 is folded to overlie panels 40 and 42, the apertures 41 will lie under opener tab 62.

FIG. 1 also presents additional details regarding the major top wall panels 38, 42. Specifically, an adhesive area is indicated by dotted line 70 that extends along the perimeter of the interior surface of major top inner wall panel 38 (i.e., the surface opposite the one shown in FIG. 1 ). Similarly, an adhesive area is indicated by dotted line 72 that extends along the perimeter of the interior surface of major top inner wall panel 42. In the preferred embodiment, the adhesive extends continuously around the panels 38, 42 just inside the perimeter thereof. Alternatively, the adhesive can be applied in dots. Other adhesive configurations that are possible (but not shown) are adhesive areas like 70 and 72, except that the segment that runs parallel to fold lines 18*a* and 22*a* is omitted. If instead of a hot-melt adhesive a cold resin is used, it can be applied in the standard manner by a roller that covers the entire interior surface of each of the panels 38, 42. In the event of such overall glue application, it may be desirable to use varnish or printed areas where adhesion should be minimized to facilitate the separation of certain areas and tabs.

FIGS. 2–7 are commonly numbered with FIG. 1 and depict the carton 11 of the present invention (or the dispenser end thereof) erected and in various stages of being opened and reclosed. To erect the carton into the configuration as in FIG. 2, the carton 11 is been formed into its generally tubular erected shape and the glue flap 24 is glued to the inside of front panel 16. The minor top wall panels 36, 40 are folded inwardly. They either slightly overlap or may abut one another. Either may be folded before the other. Glue or adhesive has been applied to adhesive areas 70, 72 on the interior surfaces of the panels 38, 42. The major top inner wall panel 42 is folded inwardly and adhered to the two minor top wall panels 36, 40. Then the major top outer wall panel 38 is folded inwardly and downwardly to overlie the major top inner wall panel 42, whereby the first aperture 50 is brought into general alignment with the second aperture 60. Tamper evident tab 52 overlies the finger edge 63*e* of the opener tab 62 and the portion of tab 62 adjacent finger edge 63*e*.

The carton 11 may be filled from the top end depicted in FIG. 2 before inward folding of panels 36, 38, 40, 42. If this is done, the major bottom end panels 28, 32 will have been folded inwardly onto the previously inwardly folded minor bottom end panels 26, 30, with all bottom panels secured in place by suitable glue or adhesive. Alternatively, the carton 11 may be filled from the open bottom end, if the top end is closed and sealed first. All of the erecting, filling and closing operations, including adhesive application, can be performed by standard cartoning equipment.

Figure 5:
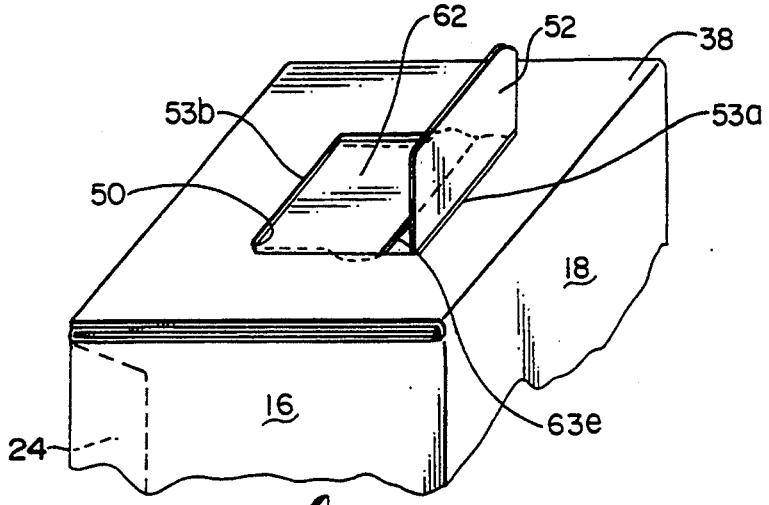
FIG. 5 is a fragmentary perspective view of the spout bearing end of a fully erected and filled carton as in FIG. 2, with the tamper evidence panel raised and partially detached.

As best seen in FIG. 3, tamper evidence tab 52 blocks access to finger edge 63*e* as long as it remains in place. Finger edge 53*c* of tamper evidence tab 52 is accessible to a fingernail or finger tip, which can be used to raise and tear tab 52 along the legs of U-shaped line of perforations 53*a*. FIG. 5 shows how tab 52 can be raised vertically during its removal. Once in this position, it is easily removed by further tearing across that part of perforated line 53*a* that connects the legs of the "U".

Figure 6:
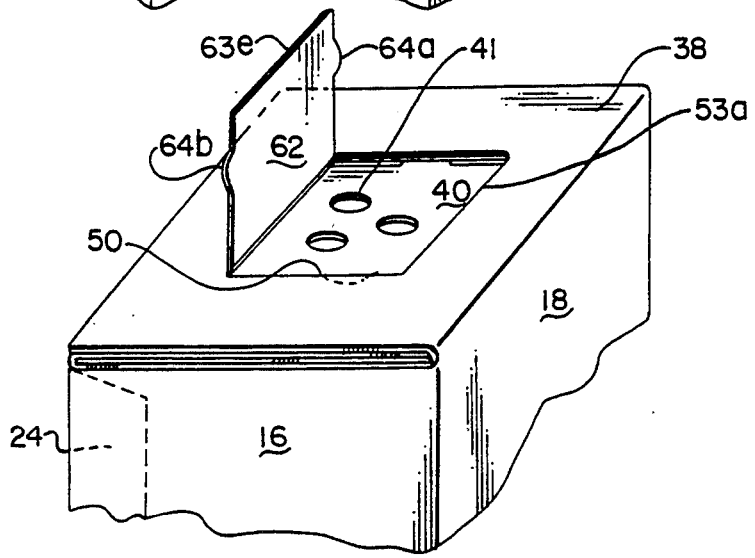
FIG. 6 is a fragmentary perspective view of the present invention with the tamper evidence panel removed and the opener panel raised to open the carton for dispensing.

After tamper evidence tab 52 is removed, opening proceeds by using a fingernail or finger tip to engage finger edge 63*e*, which can be used to raise opener tab 62 where it is severed from panel 42 along cut lines 63*c*, 63*d*. With further raising opener tab 62 tears along the legs of U-shaped line of perforations 63*a*. FIG. 6 shows how tab 62 can be raised vertically, using that part of perforated line 63*a* that connects the legs of the "U" as a hinge line. It should be noted that, as best seen in FIG. 4, the locking tabs 64*a*, 64*b* on each side of opener tab 62 must be raised past the interference caused by the way the edges of aperture 50 defined by the legs of lines 53*a* and 53*b* extend out over the locking tabs 64*a*, 64*b*. (This is aided by slight upward bowing of the tab 62 when it is lifted.) The remainder of the opener tab 62 does not substantially interfere with or engage the edge of aperture 50, but locking tabs 64*a*, 64*b* must be deflected or displaced slightly to be raised out of the plane of panel 42 and past the plane of panel 38.

Figure 7:
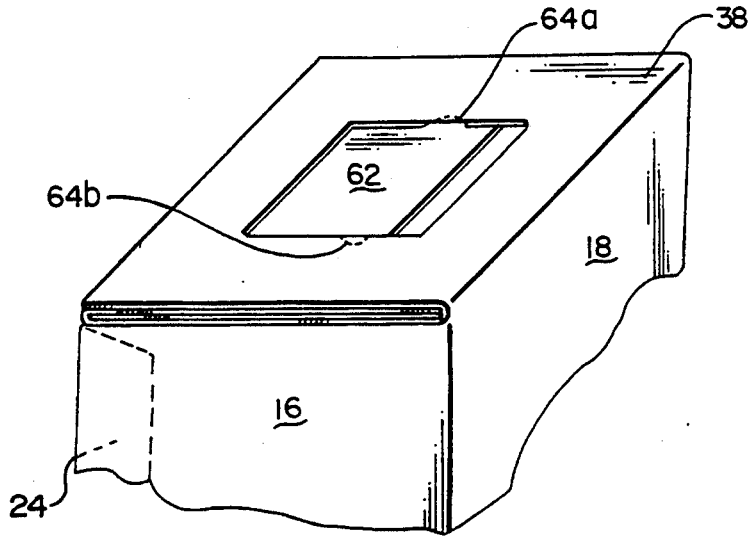
FIG. 7 is a fragmentary perspective view of the spout-bearing end of the present invention as it may appear following reclosing of the opener panel.

The reclosability of the opener tab 62 is shown in FIG. 7, in which the opener tab 62 has been rotated from its raised position as in FIG. 6 through ninety degrees until it returns to the plane of panel 42. As with raising the opener tab 62, when tab 62 is lowered, there is again interference between locking tabs 64*a*, 64*b* and the edges of aperture 50. Again, the locking tabs 64*a*, 64*b* must be displaced or deflected. This is facilitated by relatively light downward pressure applied by a fingertip in the center of tab 62. Once the locking tabs 64*a*, 64*b* have been deflected, they return to the position shown in FIG. 4, in which each underlies and engages an edge of the aperture 50 formed by the cut line 53*a*. The friction of this engagement holds the opener tab 62 in place in panel 42 until the user again exerts a raising force at finger edge 63*e*. Also, the replacement of opener tab 62 into panel 42 causes a relatively tight closure of the carton 11 against substantial air infiltration.

Figure 8:
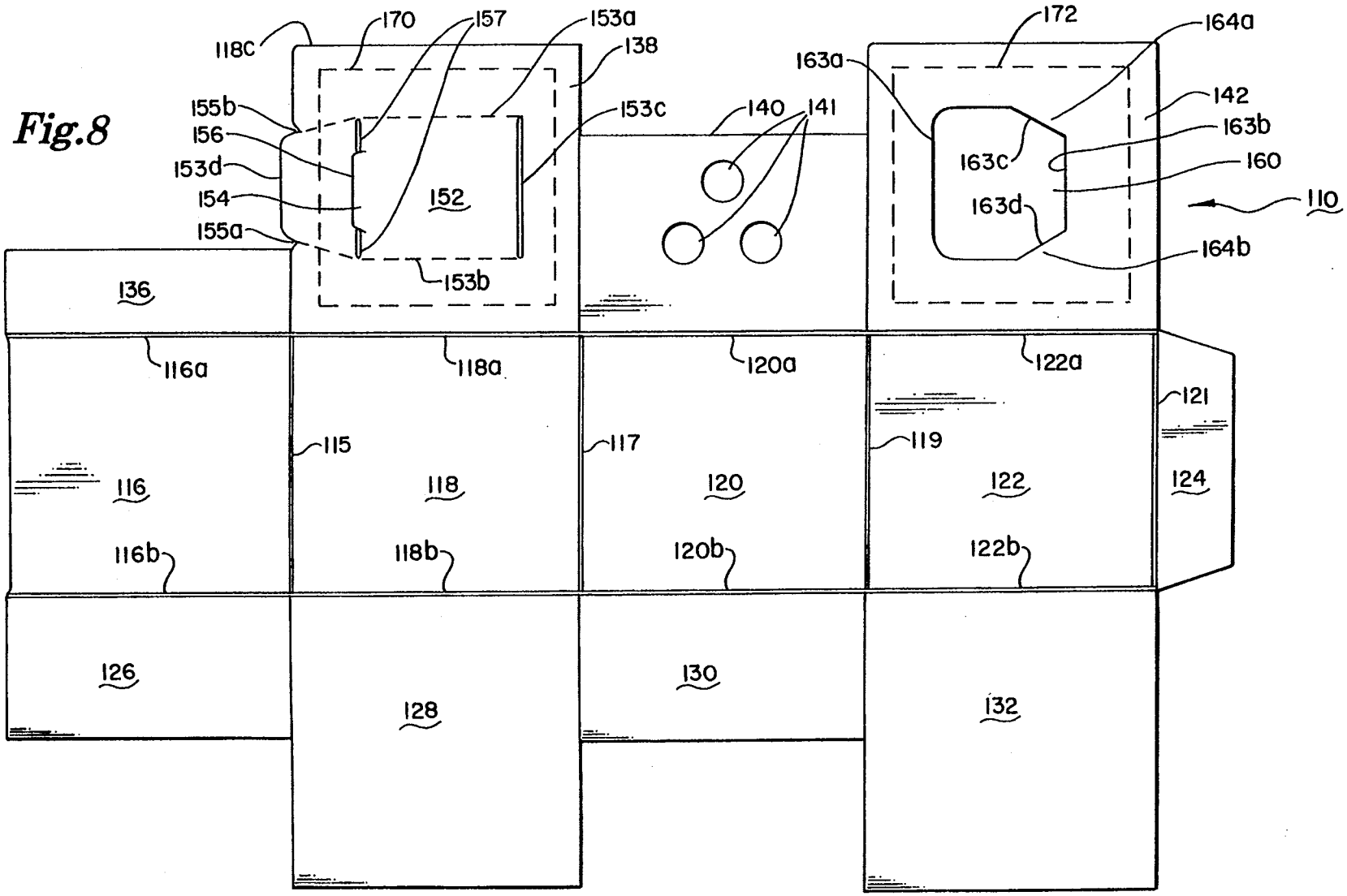
FIG. 8 is a top plan view of the printed (outside) surface of the blank from which an alternate embodiment of the present invention is formed and shows the die cut profile thereof.

FIG. 8 shows a blank 110 used for an alternate embodiment of the invention. Because there are many similarities between the blank of FIG. 8 and the previously discussed blank of FIG. 1, a reference numbering system has been used to identify corresponding parts. Thus, in FIG. 8, reference numbers 116, 118, 120, 122 and 124 indicate panels that correspond to panels 16, 18, 20, 22, and 24 in FIG. 1. Panels 126, 128, 130, 132 and fold lines 116*b*, 118*b*, 120*b*, 122*b* correspond to the panels and fold lines with the same reference numbers in FIG. 1, but without the prefix "1". Minor top wall panels 136 and 140 (with dispensing apertures 141) correspond in the same way to panels 36 and 40 in FIG. 1.

The embodiment of FIG. 8 distinguishes itself from the structure of FIG. 1 in the structure of panels 138 and 142, which correspond to panels 38 and 42 in FIG. 1, but are not identical. Major top wall panel 142 has a first aperture or opening 160. The opening 160 is generally square in shape and centered within the panel 142. It has a perimeter defined by a generally U-shaped cut line 163*a*, the ends of which connect to the ends of a pair of angled, opposed cut line segments 163*c*, 163*d* that converge and are joined by a straight cut line segment 163*b*, which (as will be seen) forms a locking edge. The segments 163*c*, 163*b*, 163*d* form a roughly U-shaped edge that is opposite the other U-shaped edge 163*a* of aperture 160. As will be explained below, the cut line segments 163*c*, 163*d* form support corners 164*a*, 164*b*.

The major top outer panel 138 is provided with an opener tab 152. The opener tab 152 is generally rectangular in shape and centered between the fold line 118*a* and the opposed free edge 118*c* of panel 138. Tab 152 has a perimeter defined by a pair of generally parallel lines of perforations 153*a*, 153*b*, joined at one end by a hinge fold line 153*c*. At the opposite end, the perforated lines 153*a*, 153*b* converge toward each other and then are connected by a leader edge 153*d*. It should be noted that leader edge 153*d* is defined at each of its ends by a curved cut segment leading to a V-shaped notch 155*a*, 155*b*. It should further be noted that the leader edge 153*d* extends beyond the free edge of panel 138 that is otherwise collinear with fold line 115 in FIG. 8.

Within opener tab 152 is a locking tab 154 defined by a cut line 156 with curved ends. A score line 157 runs from each curved end of cut line 156 to the adjacent line of perforations 153*a*, 153*b*. As will be explained further below, the opener tab 154 is positioned so that when panel 138 overlies panel 142 in the erected carton and tab 154 is deflected inwardly out of the plane of panel 138 and opener tab 152, it will underlie and engage a portion of cut line 163*b*, which functions as a locking edge.

FIG. 8 aim presents additional details regarding the major top wall panels 138, 142. Specifically, an adhesive area is indicated by dotted line 170 that extends along the perimeter of the interior surface of major top inner wall panel 38. Similarly, an adhesive area is indicated by dotted line 172 that extends along the perimeter of the interior surface of major top inner wall panel 142. Hot melt adhesives or cold resins and patterns of application (including overall application) are the same as in the embodiment shown in FIGS. 1–7, except that to aid release of the opener tab 152 from the area of panel 142 between cut line 163*b* and the adjacent, parallel free edge, it may be desirable to use varnish to minimize adhesion.

FIGS. 9–12 are commonly numbered with FIG. 8 and depict the carton 111 (or the dispenser end thereof) of the embodiment of FIG. 8 erected and in various stages of being opened and reclosed. To erect the carton into the configuration as in FIG. 9, the carton 111 is been formed into its generally tubular erected shape and the glue flap 124 is glued to the inside of side front panel 116. The minor top wall panels 136, 140 are folded inwardly. Either may be folded before the other. Glue or adhesive is applied to adhesive areas 170, 172 on the interior surfaces of the panels 138, 142. The major top inner wall panel 142 is folded inwardly and adhered to the two minor top wall panels 136, 140. Then the major top outer wall panel 138 is folded inwardly and downwardly to overlie the major top inner wall panel 142, whereby the opener tab 152 is brought into general alignment with the aperture 160. The leader edge 153*d* of the opener tab 152 extends out over the side of the carton formed by front panel 116, to provide easy grasping for opening. The other details of folding, gluing and filling, including the handling of bottom wall flaps 126, 128, 130, 132 are essentially the same as for the embodiment of FIG. 1.

Figure 9:
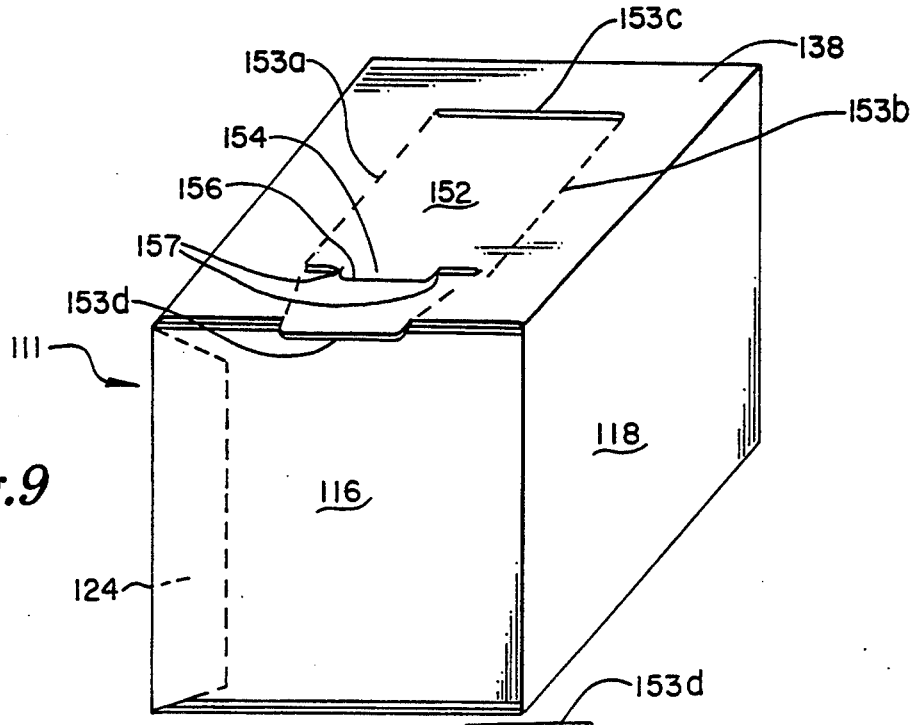
FIG. 9 is a perspective view of the blank of FIG. 8 formed into a carton in accordance with the present invention.
Figure 10:
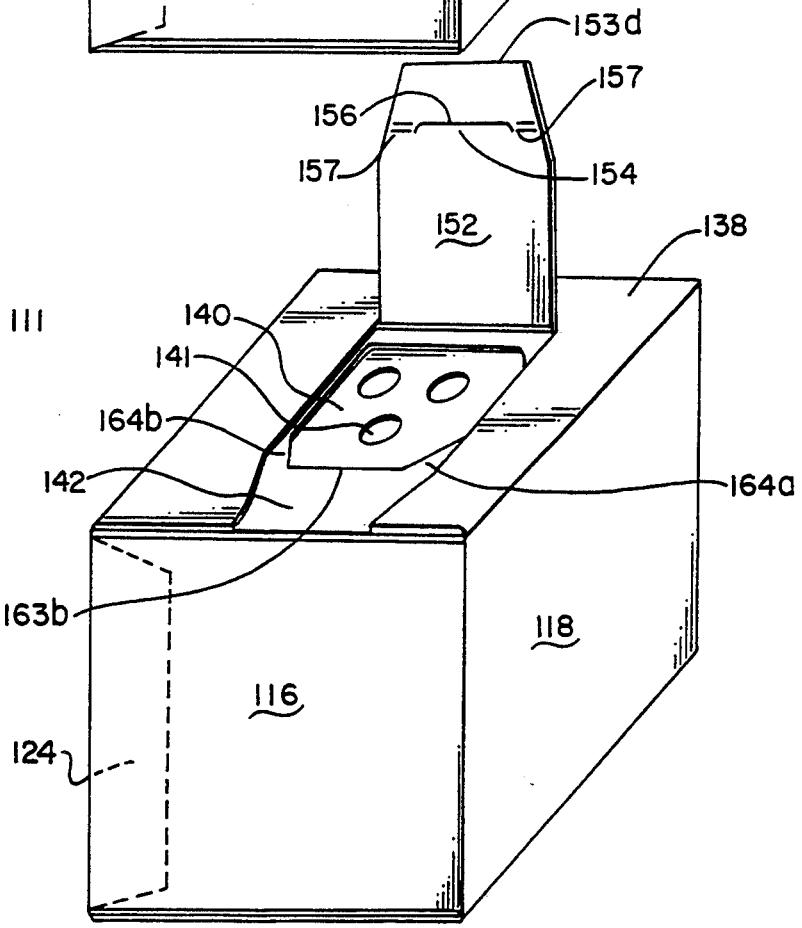
FIG. 10 is a perspective view of the alternate embodiment of the present invention as shown in FIG. 8, with the opener panel raised to open the carton for dispensing.

As best seen in FIG. 9, opener tab 152 blocks access to the aperture 160 as long as it remains in place with the perforations of lines 153*a*, 153*b* unbroken. Leader edge 153*d* of opener tab 152 is graspable using a fingernail or finger tip, which can be used to raise and tear tab 152 along the generally parallel lines of perforations 153*a*, 153*b*. FIG. 10 shows how tab 152 can be raised vertically, using the fold line 153*c* that connects the parallel lines of perforations 153*a*, 153*b* as a hinge line. It should be noted that, as the opener tab 152 is raised, it will be bent somewhat and the locking tab 154 will be loosened at cut line 156 and deflected slightly out of the plane of panel 138 by bending at scores 157. Also, any tearing of the lines of perforations 153*a*, 153*b* shows that the carton has been opened or potentially tampered with.

Figure 11:
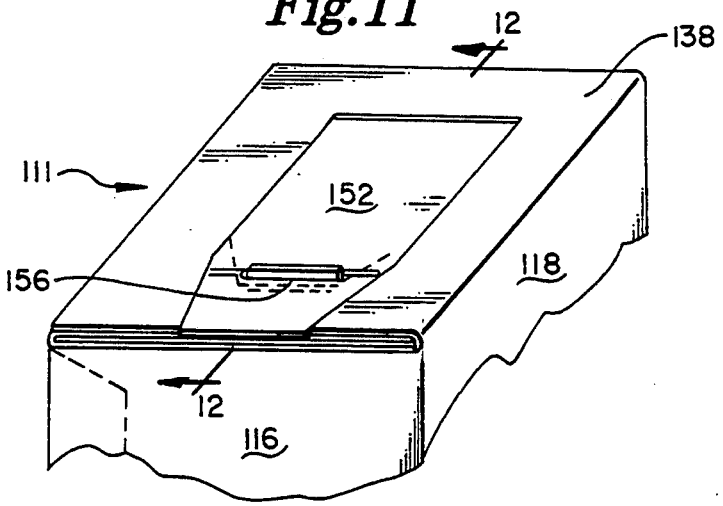
FIG. 11 is a fragmentary perspective view of the alternate embodiment of the present invention as shown in FIG. 8, as it appears following reclosing of the opener panel.
Figure 12:
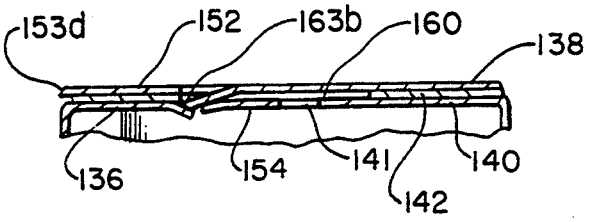
FIG. 12 is a fragmentary cross-sectional view of the carton taken along line 12—12 of FIG. 11.

The reclosability of the opener tab 152 is shown in FIGS. 11 and 12, in which the opener tab 152 has been rotated from its raised position as in FIG. 10 through ninety degrees until it returns to the plane of panel 138. When the opener tab 152 is lowered, pressure can be exerted between the two curved ends of the cut line 156. This downward pressure in the center of tab 152 causes the locking tab 154 to be deflected so that it can leave the plane of opener tab 152 and pass the interference caused by edge 163*b*. Diaphragming of tab 152 and panel 142 also aid in overcoming the interference and allowing tab 154 to lock under edge 163*b*. The support corners 164*a*, 164*b* formed by cut line segments 163*c*, 163*d* help prevent the tab 152 from being inserted into the interior of the carton 111 by the downward pressure. Once the locking tab 154 has been deflected, it underlies and engages the lower surface of panel 142 at edge 163*b* and rests in the position shown in FIG. 12. The friction of this engagement holds the opener tab 152 in place until the user again exerts a raising force at leader edge 153*d*.

Figure 13:
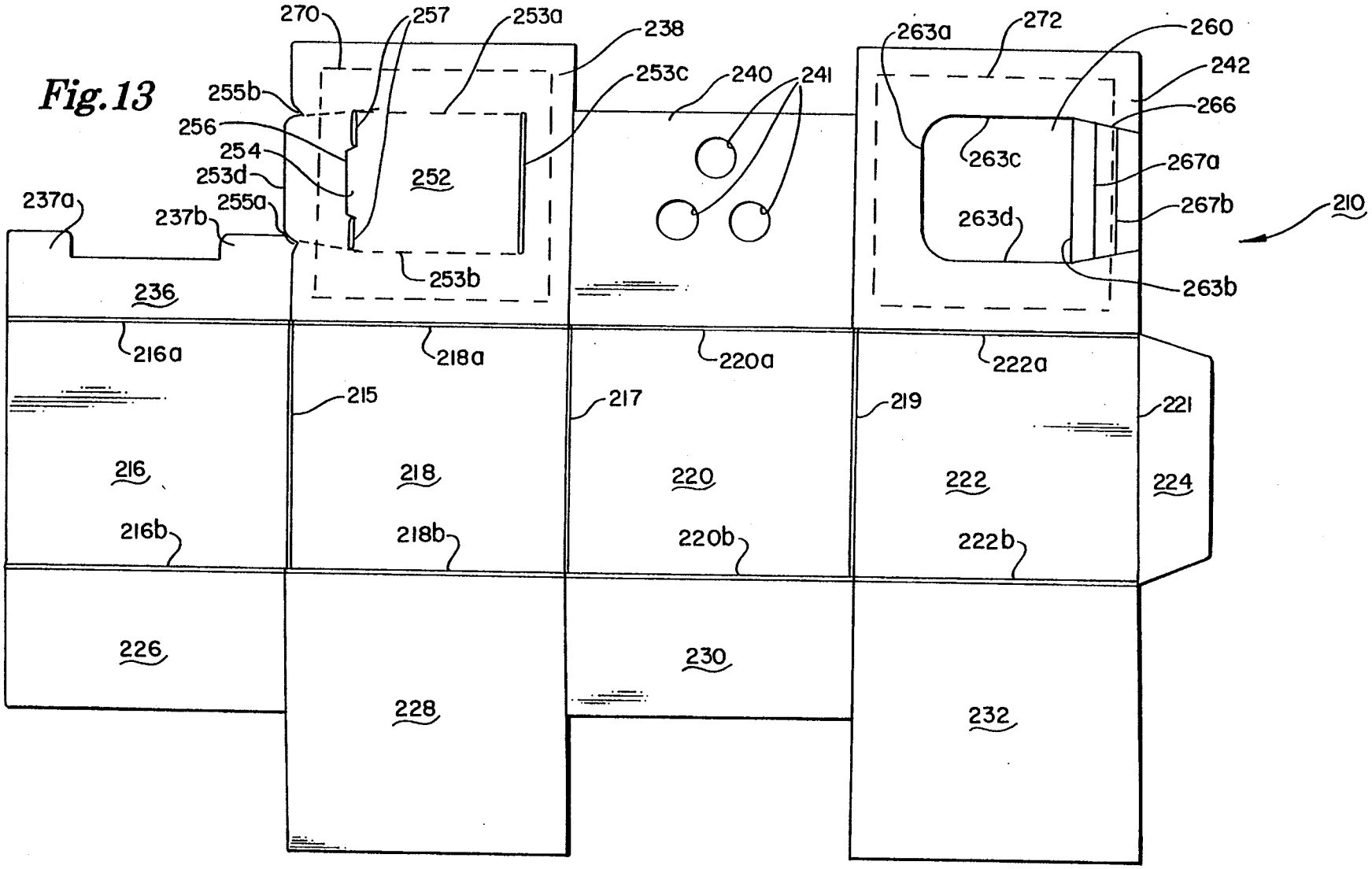
FIG. 13 is a top plan view of the printed (outside) surface of the blank from which an additional alternate embodiment of the present invention is formed and shows the die cut profile thereof.

FIG. 13 shows a blank 210 used for an additional alternate embodiment of the invention. Because there are many similarities between the blank of FIG. 13 and the previously discussed blanks of FIGS. 1 and 8, a reference numbering system has been used to identify corresponding parts. Thus, in FIG. 13, reference numbers 216, 218, 220, 222 and 224 indicate panels that correspond to panels 16, 18, 20, 22, and 24 in FIG. 1 and panels 116, 118, 120, 122, and 124 in FIG. 8. Panels 226, 228, 230, 232 and fold lines 216*b*, 218*b*, 220*b*, 222*b* correspond to the panels and fold lines with the same reference numbers in FIG. 1 but without the prefix "2" and those in FIG. 8 with a prefix "1" instead of "2". Minor top wall panel 240 (with dispensing apertures 241) corresponds in the same way to panel 40 in FIG. 1 and panel 140 in FIG. 8. Finally, major top wall panel 238 (with opener tab 252) corresponds to panel 138 in FIG. 8.

The embodiment of FIG. 13 distinguishes itself from the structure of FIG. 8 in the structure of panels 236 and 242, which correspond to panels 136 and 142 in FIG. 8, but are not identical. Minor top wall panel 236 is similar to top wall panel 136 in FIG. 8, except that it has shoulders 237*a*, 237*b* on it so that panel 240, which is folded onto panel 236 will not easily collapse inside the carton when the opener tab 252 is pressed onto these panels for reclosure. Major top wall panel 242 has a first aperture or opening 260. The opening 260 is generally square in shape and centered within the panel 242. It has a perimeter defined by a generally U-shaped cut line 263*a*, the legs 263*c*, 263*d* of which connect to the end of a straight cut line segment 263*b*. Between the segment 263*b* and the free edge of panel 242 that is collinear with fold line 221 in FIG. 13, the outside surface of panel 242 has a plurality of transverse parallel, superficial incisions 267*a*, 267*b*. The incisions penetrate 30% to 60% of the panel thickness and form a lead delamination area 266 comprising a plurality of delamination ribs between the incisions 267*a*, 267*b*. It should also be noted that the free edge of panel 242 that appears almost collinear with fold line 221 is actually relieved, so that it is inset from an extension of fold line 221. This relief makes it easier to grasp the leader edge 253*d* of opener tab 252. In fact, with even greater relief than is shown in FIG. 13, it becomes unnecessary to extend leader edge 253*d* so that it extends beyond a line extended from fold line 215.

Figure 14:
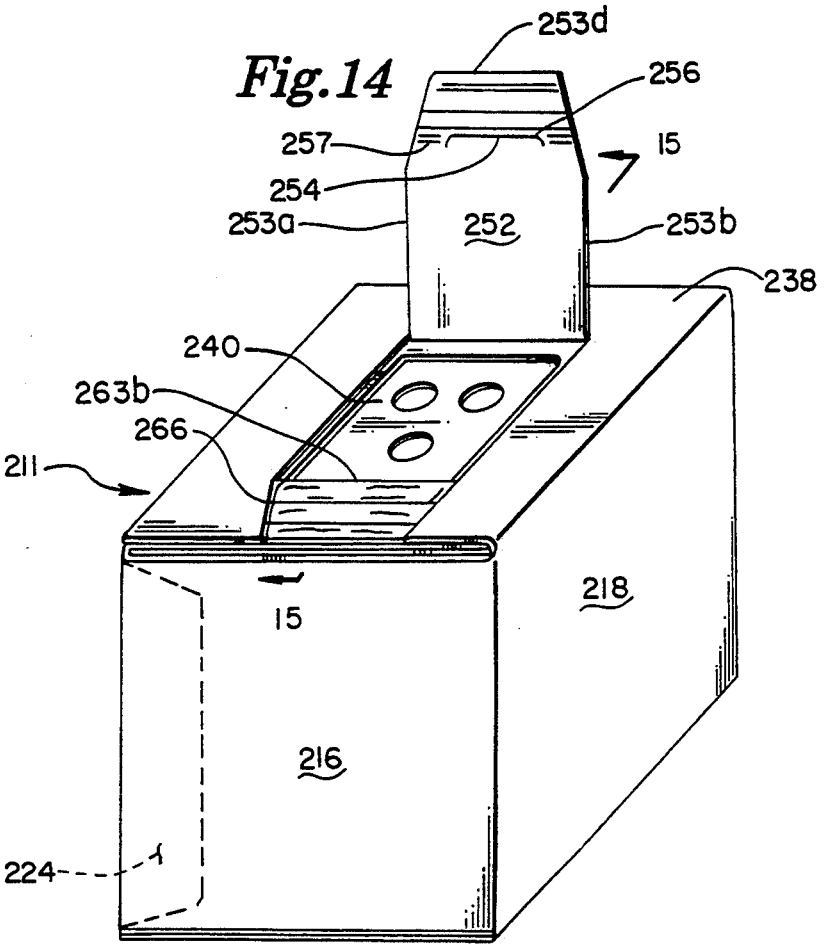
FIG. 14 is a perspective view of the alternate embodiment of the present invention as shown in FIG. 13, formed into a carton and with the opener panel raised to open the carton for dispensing.

The carton blank of FIG. 13 is folded, glued and erected in the same way as the embodiment in FIG. 8, except that panel 236 must be folded inwardly first, before panel 240. When fully erected, filled and closed, the embodiment of FIG. 13 looks essentially identical to the carton in FIG. 9. The difference comes when the opener tab 252 is lifted and rotated to open the carton 211. To lift the opener tab 252, the delamination ribs in delamination area 266 must be separated from the remainder of the material in delamination area 266. This requires slightly more force to be exerted on the opener tab 252, but leads otherwise to the same type of opening as with the embodiment of FIG. 8. Thus, FIG. 14, which shows the carton 211 with the opener tab 252 raised is identical to FIG. 10, except that the delamination ribs are present on the lower surface of the opener tab 252; the effects of their removal show at the delamination area 266 and there are no support corners in aperture 260 as in aperture 160.

Figure 15:
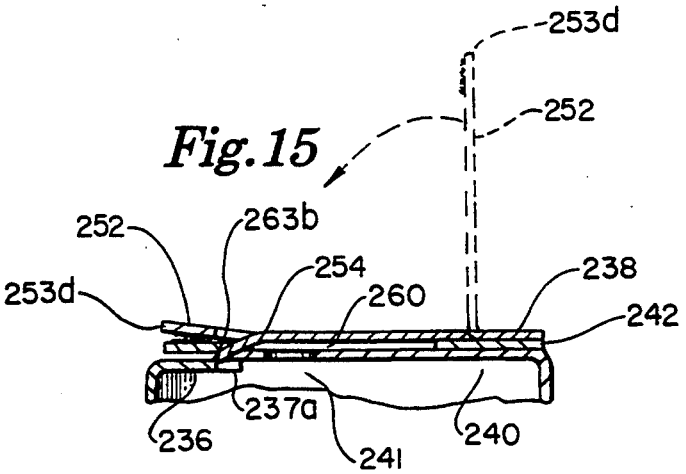
FIG. 15 is a fragmentary cross-sectional view of the carton taken along line 15—15 of FIG. 14, showing the raised opener panel in phantom, together with the opener panel in a reclosed position.

The reclosability of the opener tab 252 is shown in FIG. 15, in which the opener tab 252 is shown in phantom in a vertical position and also in solid lines after it has been rotated from its raised position as in FIG. 15 through ninety degrees until it returns to the plane of panel 238. As with the embodiment of FIG. 8, when the opener tab 252 is lowered, pressure can be exerted between the two curved ends of the cut line 256. This downward pressure near the center of tab 252 causes the locking tab 254 to be deflected so that it can leave the plane of opener tab 252 and pass the interference caused by edge 263*b*. Diaphragming of tab 252 and panel 242 also aid in overcoming the interference and allowing tab 254 to lock under edge 263*b*. The shoulders 237*a*, 237*b* formed at the ends of panel 236 help support panel 240 and thereby help prevent the tab 252 from being inserted into the interior of the carton by the downward pressure. Once the locking tab 254 has been deflected, it underlies and engages the lower surface of panel 242 at edge 263*b* and rests in the position shown in FIG. 15. The friction of this engagement holds the opener tab 252 in place until the user again exerts a raising force at leader edge 253*d*.

A number of variations of the present invention can be made. For example, the number and size of the dispenser apertures 41, 141, 241 may be changed and the perforated and/or penetrating cuts in the major top inner wall panel 42, 142, 242 may be adjusted so that any size dispensing opening may be provided. Also, the shape of aperture 50 can be oval or round or take other shapes. The shape of apertures 160 and 260 may also vary, as long as the edge 163*b* or 263*b* remains accessible for locking with a locking tab. The shape and number of the locking tabs 64*a*, 64*b* and 154, 254 may also vary, so long as the interference desired for locking is achieved. (These variations should, of course, avoid providing any direct path for sifting of material to the outside.) While the position of the dispenser for the carton 11 has been depicted at or near the center of the top wall of rectangular carton 11, the spout might be located where convenient elsewhere on the same top end-closure wall (i.e., nearer an edge), or on another wall having a closure structure using similar overlapping panels or on a non-rectangular carton having a closure structure having similar overlapping panels.

The material from which the present invention is fabricated may be of paperboard or any suitable stiff but still flexible sheet material, and, in fact, the carton may be formed from sheet plastics or other similar materials. Additionally, any paperboard used may be coated with various substances to impart desirable characteristics thereto such as greater resistance to liquids. For further sealing, the carton may be overwrapped with any thermoplastic film or other suitable material. Both the interior and the exterior of the carton may be marked with appropriate indicia and may be provided with other features to facilitate the handling, transportation and retailing of the carton and the product therein.

It should be understood that as an alternative to assembling the carton as a tube, the producer of the carton may provide the carton in blank form, in a completely flat, unerected condition. Thus, the purchaser of the carton of the present invention has the option of how to purchase it.

Although the description of the preferred embodiment has been presented, it is contemplated that various changes, including those mentioned above, could be made without deviating from the spirit of the present invention. It is desired, therefore, that the present embodiment be considered in all respects as illustrative, not restrictive, and that reference be made to the appended claims rather than the foregoing description to indicate the scope of the invention.

What is claimed and desired to be protected by Letters Patent is:

1. A tamper-evidencing, recloseable pouring spout structure for a wall of a product dispensing carton, comprising:

a first wall panel connected to the carton at a first fold line, said first wall panel having a first, generally central aperture therein, a removable tamper-evidence tab closing a portion of the first aperture, wherein the first aperture of the first wall panel has an aperture perimeter defined in part by a generally U-shaped line of perforations with two ends and in part by an opposed, generally U-shaped cut line with two ends, the line of perforations and the cut line being connected to each other at their respective ends, said removable tamper-evidence tab having a free edge and closing the portion of the aperture having the aperture perimeter defined by the generally U-shaped line of perforations, said free edge extending between the ends of the line of perforations;

a second wall panel connected to the carton at a second fold line generally parallel and opposite to the first fold line, said second wall panel lying interior to said first wall panel and having an opener tab therein defined by a leader edge that is generally parallel to the second fold line, a pair of generally parallel opposed side edges extending from the leader edge to a hinge line generally parallel to the leader edge, and at least one locking tab on one of said side edges intermediate the leader edge and the hinge line, said locking tab extending in a direction generally perpendicular to the extension direction of the leader tab and positioned to underlie and engage an edge of the first aperture when the locking tab is in the plane of the second wall panel; and a third wall panel connected to the carton at a third fold line generally perpendicular to the first and second fold lines, said third wall panel lying interior to the first and second wall panels and having one or more product dispensing apertures therein.

2. A structure as recited in claim 1 wherein the tamper-evidence tab is integrally formed with the first wall panel and has a first, free finger edge that extends across the first aperture between the ends of the generally U-shaped line of perforations and is generally parallel to the first fold line.

3. A structure as recited in claim 2 wherein the second wall panel has a second aperture and the opener tab is integrally formed within the second aperture.

4. A structure as recited in claim 3 wherein the opener tab is joined to the second wall panel at a generally U-shaped line of weakness and has a second finger edge that extends across the second aperture and is generally parallel to the second fold line.

5. A structure as recited in claim 4 wherein the tamper-evidence tab covers the second finger edge and a portion of the opener tab prior to removal of the tamper-evidence tab from the first wall panel.

6. A structure as recited in claim 1 wherein the at least one locking tab comprises two locking tabs intermediate the leader edge and the hinge line, one located on each of the opposed side edges of the opener tab, each said locking tab extending in a direction generally perpendicular to the extension direction of the leader tab and being spaced apart such that each underlies and engages an edge of the first aperture when the locking tab is in the plane of the second wall panel.

7. The structure as recited in claim 6 wherein each locking tab is an arcuate tab extending from the opener tab.

8. The structure as recited in claim 1 further comprising:

first adhesive means for connecting the first and second wall panels, wherein said first adhesive means lies between the first and second wall panels and substantially encircles the first aperture; and second adhesive means for connecting the second and third wall panels, wherein said second adhesive means lies between the second and third wall panels and substantially encircles the opener tab.

9. A one-piece blank for forming a carton with a recloseable pouring spout, comprising:

a plurality of consecutively joined main body panels for forming front, rear and side walls of the carton;

a plurality of bottom wall closure panels joined to the main body panels of the carton; and a plurality of top wall closure panels comprising:

a first top wall panel connected to the main body panels at a first fold line, said first wall panel having a first, generally central aperture therein, a removable tamper-evidence tab closing a portion of the first aperture, wherein the first aperture has an aperture perimeter defined in part by a generally U-shaped line of perforations with two ends and in part by an opposed, generally U-shaped cut line with two ends, the line of perforations and the cut line being connected to each other at their respective ends, said removable tamper-evidence tab having a free edge and closing the portion of the aperture having the aperture perimeter defined by the generally U-shaped line of perforations, said free edge extending between the ends of the line of perforations;

a second top wall panel connected to the main body panels at a second fold line generally collinear with the first fold line, said second top wall panel having an opener tab therein defined by a leader edge that is generally parallel to the second fold line, a pair of generally parallel opposed side edges extending from the leader edge to a hinge line generally parallel to the leader edge, and two locking tabs intermediate the leader edge and the hinge line, one located on each of the opposed side edges of the opener tab, each said locking tab extending in a direction generally perpendicular to the extension direction of the leader tab and being spaced apart a distance that is slightly greater than the width of the first aperture measured in a direction parallel to the first fold line; and a third top wall panel connected to the main body panels at a third fold line generally collinear with the first and second fold lines, said third wall panel having one or more product dispensing apertures therein.

10. A blank as recited in claim 9 wherein the tamper-evidence tab is integrally formed with the first wall panel and has a first finger edge that extends across the first aperture and is generally parallel to the first fold line.

11. A blank as recited in claim 10 wherein the tamper evidence tab is joined to the first wall panel at a generally U-shaped line of weakness and the first finger edge extends between the legs of the U-shaped line of weakness in the first wall panel.

12. A blank as recited in claim 10 wherein the second wall panel has a second aperture and the opener tab is integrally formed within the second aperture.

13. A blank as recited in claim 12 wherein the opener tab is joined to the second wall panel at a generally U-shaped line of weakness and has a second finger edge that extends across the second aperture and is generally parallel to the second fold line.

14. The blank as recited in claim 9 wherein each locking tab is an arcuate tab extending from the opener tab.

15. A tamper-evidencing, substantially sift-proof carton for providing evidence of tampering and a substantial degree of barrier protection for the contents, said carton having foldably joined main body walls including front, rear and side walls, bottom closure panels foldably joined to said main body walls, and top closure panels foldably joined to said main body walls, the top closure panels cooperatively defining a recloseable pouring spout and comprising:

an outer top closure panel foldably connected to one of said main body walls at a first fold line and having a generally central aperture with a peripheral edge, said aperture defined in first part by a generally U-shaped line of perforations with two ends and in second part by an opposed, generally U-shaped cut line with two ends, the line of perforations and the cut line being connected to each other at respective ends, a removable tamper-evidence tab closing the part of the aperture defined by the line of perforations, the tab being formed integrally with the outer top closure panel and having a free edge, the free edge being parallel to the first fold line and extending across the aperture between the ends of the line of perforations;

a second top closure panel foldably connected to another of said main body walls at a second fold line parallel and opposite to said first fold line, said second top closure panel underlying the outer top closure panel and having a generally central opener tab defined therein by a free leader edge, a hinge line and two side edges defined by a pair of parallel weakened lines extending from the leader edge to the hinge line, said opener tab including a locking tab on each side edge between the leader edge and hinge line, each locking tab extending transversely outwardly relative to its respective side edge and underlying the edge of the aperture in the outer top closure panel when the opener tab is generally coplanar with the second top closure panel; and a third top closure panel foldably connected to another of said main body walls at a third fold line generally perpendicular to said first and second fold lines, said third top closure panel underlying said second top closure panel and having one or more contents dispensing apertures therein.

16. The carton according to claim 15 wherein the top closure panels include cuts, scores and perforations for forming said recloseable pouring spout, said cuts, scores and perforations being substantially unaligned with respect to each other, whereby, when said recloseable pouring spout is closed, there is no direct path from outside the carton to the contents.

17. The carton according to claim 15 wherein said one or more contents dispensing apertures, opener tab and the aperture in the outer top closure panel each have a peripheral edge, the peripheral edge of said dispensing apertures being offset with respect to the peripheral edge of said opener tab.

18. The carton according to claim 17 wherein said peripheral edges of the one or more dispensing apertures, opener tab and aperture in the outer top closure panel are offset with respect to each other.

* * * * *